US010066480B2

(12) United States Patent
Whitacre et al.

(10) Patent No.: US 10,066,480 B2
(45) Date of Patent: Sep. 4, 2018

(54) CHANNEL IMPULSE RESPONSE IDENTIFICATION AND COMPENSATION

(71) Applicant: Scientific Drilling International, Inc., Houston, TX (US)

(72) Inventors: Tim Whitacre, Paso Robles, CA (US); Matthew A. White, Templeton, CA (US); Brett Vansteenwyk, Paso Robles, CA (US)

(73) Assignee: Scientific Drilling International, Inc., Houston, TX (US)

( * ) Notice: Subject to any disclaimer, the term of this patent is extended or adjusted under 35 U.S.C. 154(b) by 358 days.

(21) Appl. No.: 14/283,677

(22) Filed: May 21, 2014

(65) Prior Publication Data

US 2014/0354444 A1 Dec. 4, 2014

Related U.S. Application Data

(60) Provisional application No. 61/828,505, filed on May 29, 2013.

(51) Int. Cl.
*E21B 47/18* (2012.01)

(52) U.S. Cl.
CPC ..... *E21B 47/18* (2013.01)

(58) Field of Classification Search
CPC ..... E21B 47/18; E21B 47/12; E21B 47/182; E21B 47/185; E21B 47/16; G01V 11/002; Y10T 137/0318; H04B 1/10; G06F 12/0835; H04L 27/2017; H04L 27/22; H04L 43/0882; H04L 43/12; H04L 43/16
(Continued)

(56) References Cited

U.S. PATENT DOCUMENTS 8,294,591 B2 10/2012 Reed et al.
8,302,685 B2 11/2012 Reyes et al.
(Continued)

FOREIGN PATENT DOCUMENTS

EP 0617196 A2 9/1994

OTHER PUBLICATIONS

Christian Klotz, Paul Richard Bond, Ingolf Wassermann, Stefan Priegnitz; IADC/SPE Paper 112683 "A New Mud Pulse Telemetry System for Enhanced MWD/LWD Applications" (need date and number of pages).

(Continued)

*Primary Examiner* — Muhammad N Edun
*Assistant Examiner* — Jerold Murphy
(74) *Attorney, Agent, or Firm* — Adolph Locklar

(57) ABSTRACT

A method of interpreting a signal transmitted through a drilling fluid disposed within a telemetry channel of a wellbore that includes defining a finite number of distinct message signals for representing conditions within the wellbore. The method also includes transmitting one of the message signals through the telemetry channel, and receiving a distorted signal that includes the message signal as distorted by transmission through the telemetry channel. A channel impulse response is estimated and applied to at least one of the message signals to generate at least one predicted signal. A comparison is made between the predicted signal and the distorted signal, and an estimation is made as to which of the finite number of message signals is included in the distorted signal based on the comparison.

15 Claims, 3 Drawing Sheets

(58) Field of Classification Search
USPC ..... 340/853.1–856.4
See application file for complete search history.

(56) References Cited

U.S. PATENT DOCUMENTS

| | | | | |
|---|---|---|---|---|
| 8,654,932 | B2 | 2/2014 | Matityahu et al. | |
| 2003/0218940 | A1 | 11/2003 | Jogi et al. | |
| 2005/0001737 | A1* | 1/2005 | Baron | G01V 11/002 340/854.4 |
| 2006/0098531 | A1 | 5/2006 | Gardner et al. | |
| 2006/0227005 | A1 | 10/2006 | Fincher et al. | |
| 2007/0132606 | A1 | 6/2007 | Reckmann et al. | |
| 2007/0189119 | A1 | 8/2007 | Klotz et al. | |
| 2007/0201308 | A1 | 8/2007 | Wassermann et al. | |
| 2009/0016160 | A1 | 1/2009 | Wassermann et al. | |
| 2009/0135023 | A1 | 5/2009 | Wassermann et al. | |
| 2013/0181843 | A1 | 7/2013 | Moghaddamnia et al. | |
| 2015/0226058 | A1* | 8/2015 | Stolpman | E21B 47/18 702/9 |

OTHER PUBLICATIONS

International Search Report and Written Opinion issued in International Application No. PCT/US2014/038953, dated Oct. 1, 2014 (7 pages).
Extended European Search Report issued in Application No. 14804293.0, dated Dec. 16, 2016 (7 pages).

* cited by examiner

CHANNEL IMPULSE RESPONSE IDENTIFICATION AND COMPENSATION

CROSS-REFERENCE TO RELATED APPLICATIONS

This application is a non-provisional application which claims priority from U.S. provisional application No. 61/828,505, filed May 29, 2013.

TECHNICAL FIELD/FIELD OF THE DISCLOSURE

This disclosure relates generally to wellbore communication. In particular, the disclosure relates to mud pulse telemetry systems for transmitting information detected from within a wellbore to the surface or to another location within the wellbore.

BACKGROUND OF THE DISCLOSURE

Often in drilling an oil or gas well, drilling fluids, (commonly referred to as "mud") are circulated through the wellbore. The drilling fluids operate to convey cuttings generated by a drill bit to the surface, drive a down-hole drilling motor, lubricate bearings and a variety of other functions. Wellbore telemetry systems are often provided to transmit information from the bottom of a wellbore to the surface of the earth through the column of drilling fluids in a wellbore. This information might include parameters related to the drilling operation such as down-hole pressures, temperatures, orientations of drilling tools, etc., and/or parameters related to the subterranean rock formations at the bottom of the wellbore such as density, porosity, etc.

Telemetry systems generally include a variety of sensors disposed within a wellbore to collect the desired data. The sensors communicate with a transmitter, such as a mud pulse tool (MP tool), also disposed within the wellbore. The MP tool might, e.g., be configured to generate known patterns of pressure fluctuations in the mud stream that correspond to the sensed data. The patterns of pressure fluctuations travel as waves to a receiver at the surface of the wellbore where pressure sensors associated with the receiver measure pressure fluctuations as a function of time. A decoder is generally provided in communication with the receiver to interpret the pressure measurements made at the surface.

The pressure waves generated by an MP tool are subject to attenuation, reflections, and noise as they move through the mud stream. For example, a first pressure wave generated by an MP tool might be reflected off the bottom of the wellbore and be superimposed with a second pressure wave generated by the MP tool as the pressure waves travel up the wellbore. Also, the pressure waves transmitted by the MP tool may combine with noise sources such as pressure waves generated by mud pumps at the surface, or by various down-hole components such as a drilling motor, and a drill bit interacting with the subterranean rock formation being drilled. These factors tend to degrade the quality of the signal and may make it difficult to recover the transmitted information.

Various methods may be employed in an attempt to reduce the interfering effects of the external factors in a telemetry system, and to more accurately interpret the data received.

SUMMARY

The present disclosure provides for a method of interpreting a signal. The method may include defining a finite number of distinct message signals for representing conditions within a wellbore; transmitting a selected one of the finite number of message signals through a drilling fluid disposed within a telemetry channel of the wellbore; receiving a distorted signal that includes the selected one of the finite number of message signals as distorted by transmission through the telemetry channel; estimating a channel impulse response describing the effects of transmission of the selected one of the finite number of message signals through the telemetry channel; applying the estimated channel impulse response to at least one of the finite number of distinct message signals to generate at least one predicted signal; making a comparison between the at least one predicted signal and the distorted signal; and estimating which of the finite number of message signals is included in the distorted signal based on the comparison.

The present disclosure also provides for an interpretation module for interpreting data received from a telemetry channel of a wellbore. The interpretation module may include a storage unit including a non-transitory, computer readable medium for storing a plurality of pressure readings representing a distorted signal received from the telemetry channel; a decoder including a non-transitory, computer readable medium including instructions for estimating and outputting an estimated signal representing which of a finite number of predetermined message signals is included in the plurality of pressure readings representing the distorted signal; and a processor for estimating a channel impulse response "x" for the telemetry channel, the processor including a non-transitory, computer readable medium including instructions for generating an observation vector "b" including the plurality of pressure readings representing the distorted signal, creating a design matrix "A" including ideal pressure pulses synthesized representing the estimated signal, and for solving the equation $Ax=b$ for "x" to arrive at an estimated channel impulse response "x".

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
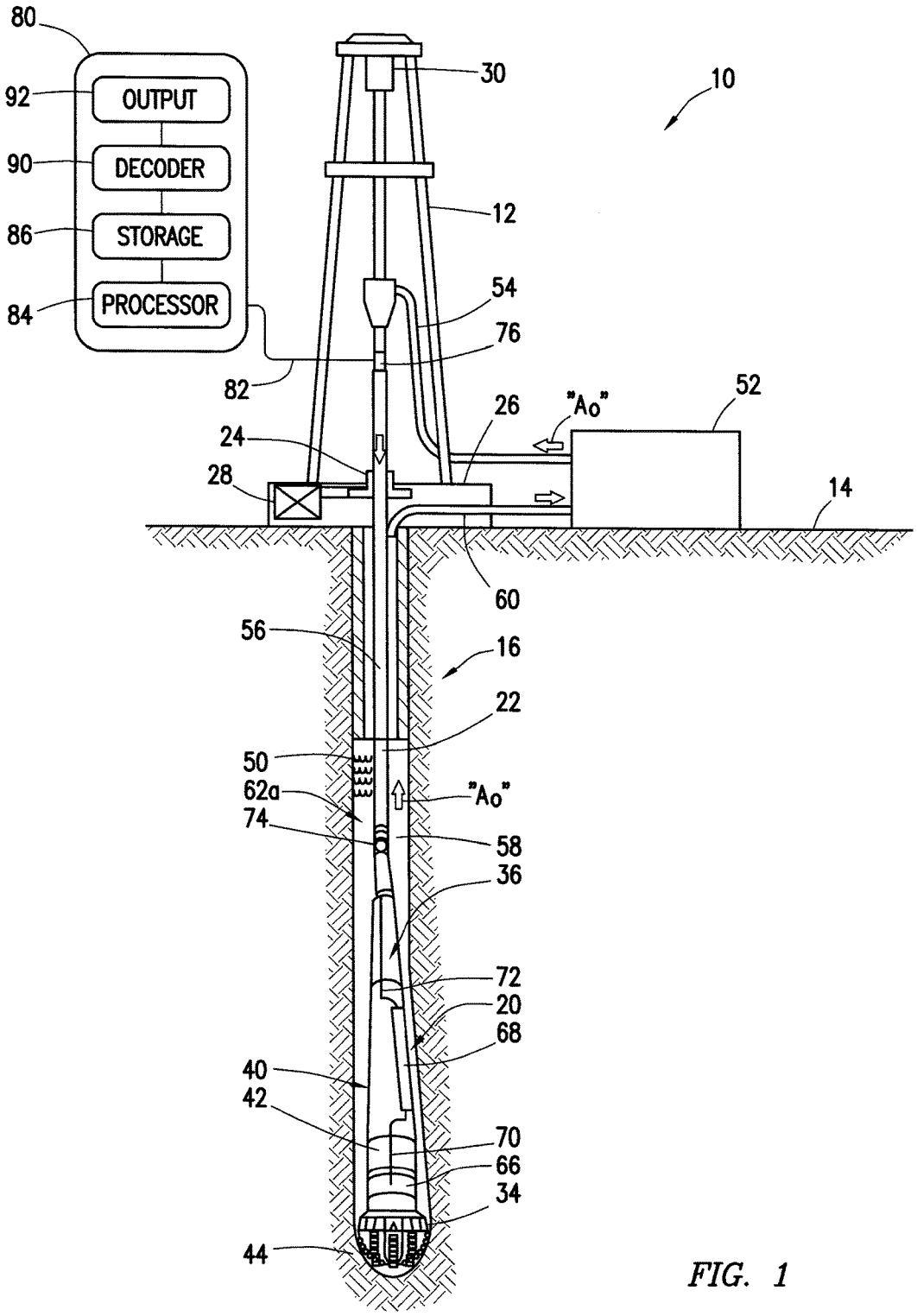
FIG. 1 is a schematic illustration of a drilling apparatus including a telemetry system and an interpretation module with processing equipment in accordance with one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drilling apparatus 10 of the present disclosure. Apparatus 10 generally includes drilling rig 12 located at upper surface 14 of wellbore 16, and bottom-hole assembly 20 at a lower end of drill string 22. As used herein, the term "upper" refers to a direction or side of a component that is oriented toward the surface of a wellbore, while the term "lower refers" to the direction or side of a component oriented toward the portion of the wellbore most distant from the surface. Drill string 22 may be rotatably driven from drilling rig 12 by rotary table 24 on drilling platform 26. Rotary table 24 may be driven by motor 28. The drill string may also be raised and lowered from drilling rig 12 by draw works 30.

Bottom-hole assembly 20 may include rotatable drill bit 34 at a lower end thereof. Drill bit 34 may be rotated with respect to wellbore 16 in response to rotation of drill string 22 by rotary table 24, and/or by the operation of down-hole drilling motor 36. bearing section 40 is provided, which permits rotary motion of drill bit 34 with respect to housing 42 of bottom-hole assembly 20 when down-hole drilling motor 36 is employed. Rotation of drill bit 34 permits drilling apparatus 10 to penetrate deeper into subterranean geologic formation 44.

Drilling operations may generally include the circulation of drilling fluid 50 in wellbore 16 by mud pump 52 in the direction of arrows "$A_0$". Drilling fluid 50 is passed from mud pump 52 through fluid line 54 into interior channel 56 of drill string 22. Interior channel 56 extends to bottom-hole assembly 20 where drilling fluid 50 may be passed through down-hole drilling motor 36 to drill bit 34, thereby driving drilling motor 36 and drill bit 34. In some instances, drilling fluid 50 may bypass drilling motor 36 and proceed directly to drill bit 34. Drilling fluid 50 is discharged through an opening in drill bit 34 and circulated to surface 14 through annular space 58 between drill string 22 and wellbore 16. Drilling fluid 50 serves to lubricate drill bit 34, and carry cuttings away from drill bit 34. fluid line 60 carries drilling fluid 50 from wellbore 16 back to mud pump 52. In accordance with at least one aspect of the present disclosure, drilling fluid 50 may also serve as a medium through which telemetry message signals 62*a* may be transmitted, as described in greater detail below.

Embodiments of the present disclosure include sensor module 66 disposed at or near drill bit 34 in, for example, a smart motor sensor bay. Embodiments may also include sensor module 66 disposed above drilling motor 36. In some embodiments, sensor module 66 disposed above the drilling motor may be on the same electrically wired bus as MP tool 74. Each sensor module 66 may include at least one sensor to gather data relating to drilling parameters such as torque supplied to drill bit 34, flow rate of drilling fluid 50, weight supplied to drill bit 34, etc. Sensor module 66 may also include sensors adapted to gather data relating to subterranean geologic formation 44 such as porosity, density, and magnetic resonance information etc.

Sensor module 66 is in communication with MP tool 74 by first communication link 70 (represented schematically). First communication link 70 could be a wired connection, an EM or radio link, a mud-pulse telemetry link or another type of communication link known in the art. MP tool 74 may contain additional sensors and/or circuitry. For example, MP tool 74 may include a non-transitory, computer readable medium and/or a database containing a finite number of message signals 62*a*, as well as containing algorithms for determining which of the finite number of message signals 62*a* best represents data which may have been sensed by sensor module 66. Second communication link 72 (represented schematically), which may include systems similar to first communication link 70, couples MP tool 74 to pulser module 75. Pulser module 75 might include a valve to temporarily restrict flow of drilling fluid 50 by a known amount for known amounts of time. For example, the valve of pulser module 75 may include a linear piston driven by a pilot valve, a motor driven rotary valve, or other type of mechanism known in the art.

Together, MP tool 74 and pulser module 75 may be configured to generate patterns of pressure fluctuations in drilling fluid 50 to generate telemetry message signals 62*a* based on the sensed data. In some embodiments, MP tool 74 may include software to cause pulser module 75 to generate one of the finite number of selectable message signals 62*a*. For example, the conditions sensed by sensor module 66 may be categorized into one of a finite number of groups, each of which corresponds to one of the finite number of message signals 62*a*. Circuitry or software associated with MP tool 74 may then determine into which group the sensed conditions fall, and generate a command signal instructing pulser module 75 to generate the associated message signal. Alternatively, MP tool 74 may include algorithms suitable for coding the sensed conditions into a sequence or series of the finite number of message signals 62*a*. In some embodiments, a suitable finite number of message signals 62*a* for representing sensed conditions may be about 144 message signals 62*a*. MP tool 74 may also include algorithms suitable to determine what portions of the data collected are to be sent to the surface while drilling. MP tool 74 may also store all data collected into on-board memory, and upload the data to the surface after the completion of a drilling operation.

The generated message signals 62*a* are transmitted to surface 14 of the wellbore through drilling fluid 50. As depicted in FIG. 1, the message signals 62*a* may be transmitted to the surface though drilling fluid 50 disposed within interior channel 56 of drill string 22. This representation is for illustrative purposes only, and it will be recognized that the message signals 62*a* may be transmitted through other passageways such as drilling fluid 50 within annular space 58 between drill string 22 and wellbore 16 or a through drilling fluid disposed within a dedicated telemetry channel (not shown).

When the generated message signals 62*a* travel to surface 14, message signals 62*a* may be subject to the distorting characteristics of the travel path, noise generated by reflected signals and/or by the circulation of drilling fluid 50 by mud pump 52. Thus, distorted signals 62*b* received by up-hole receiver 76 often bear little resemblance to any of the finite number of known message signals 62*a* that might be generated by MP tool 74. Receiver 76 may include a pressure transducer that converts acoustic or pressure readings representing the distorted signals 62*b* into electrical signals. The electrical signals are transmitted to interpretation module 80 through electrical conduit 82.

Interpretation module 80 converts the electrical signals into meaningful information concerning the sensed data. Interpretation module 80 is comprised of a plurality of interconnected sub-modules including processor 84, storage unit 86, decoder 90, and output device 92. Each of sub-modules 84, 86, 90, and 92 may include a non-transitory, computer readable medium including instructions or algorithms for performing the operations described below. Processor 84 is configured to receive and manipulate electrical signals and/or data, and may comprise a computer processor. Processor 84 may also include algorithms that make decisions about various commands or request signals and/or output signals to other sub-modules 86, 90, and 92. Storage unit 86 may include data storage devices such as flash memory, magnetic disks, random-access memory (RAM) erasable programmable memory (EPROM), or any other type of storage medium suitable for storing pressure readings and other information.

Decoder 90 is configured to make decisions related to a signal input thereto. For example, decoder 90 may include a comparator (not shown) configured to compare electrical signals representing a distorted signal 62*b* with any number of predicted signals. The predicted signals may be stored in storage module 84, may be generated by processor 84 "on the fly," or may originate from within decoder 90. The predicted signals may include a plurality of representations of each of the finite number of message signals 62*a* based on an estimate of the channel impulse response of the telemetry channel as described in greater detail below. Decoder 90 may make a decision based on a comparison between the distorted signal 62*b* and the predicted signals to interpret distorted signal 62*b*. For example, decoder 90 may identify the specific message signal 62*a* corresponding to the particular predicted signal most closely resembling the distorted signal 62*b*, and output this specific message signal. The output of decoder 90 may then be transmitted to output device 92, which may include a display screen or any suitable communication media to communicate the output of decoder 90 to information to the users or to other sub-modules, e.g., storage module 84 and processor 86.

Figure 2:
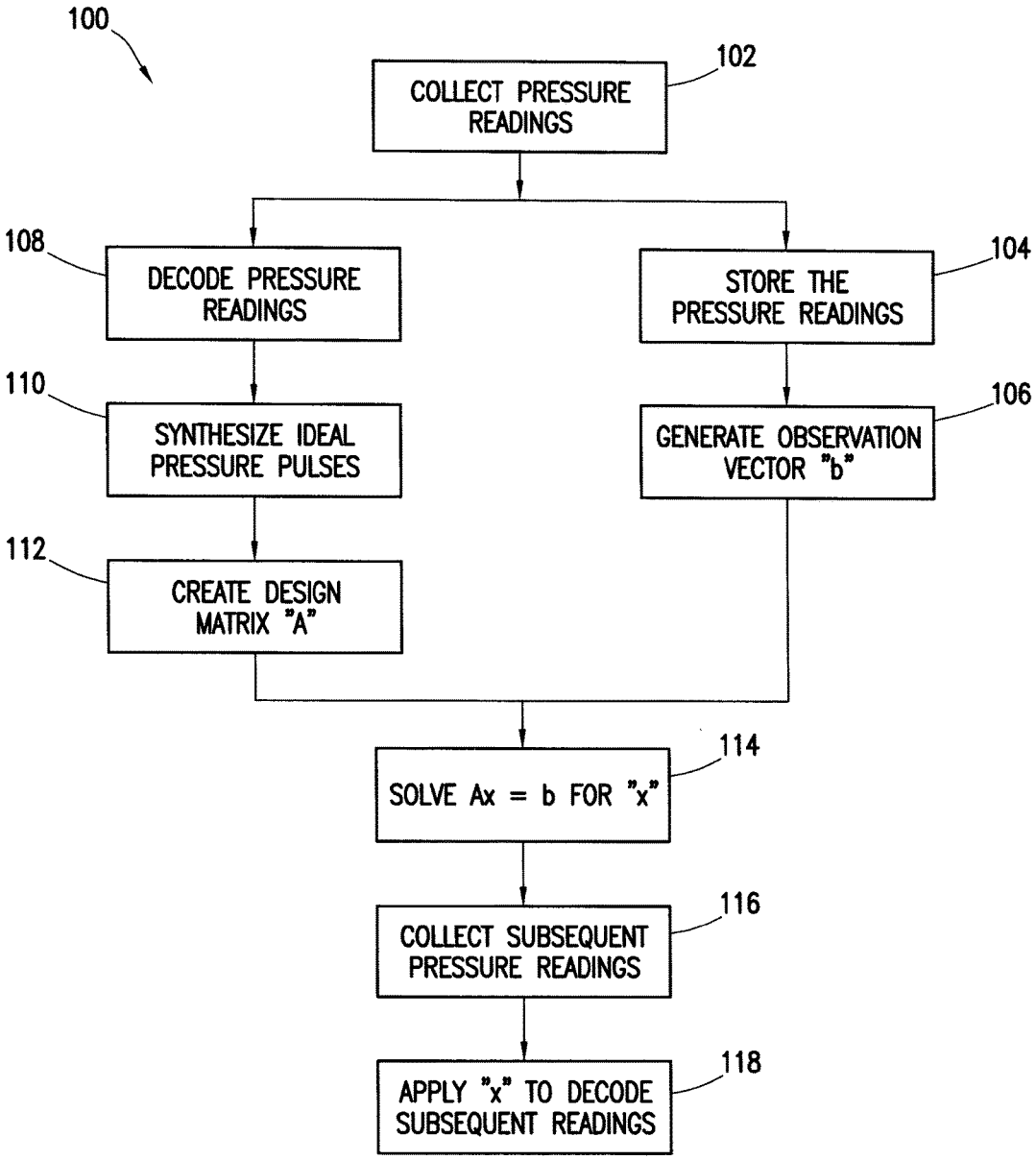
FIG. 2 is a flow chart depicting a method of the present disclosure.

Referring now to FIG. 2, procedure 100 in accordance with the present disclosure is described for determining and applying a finite channel impulse response estimate for interpreting signals received at receiver 76. Procedure 100 commences with the collection of pressure readings from drilling fluid 50 (box 102) wherein drilling fluid 50 has been imparted with pressure fluctuations from MP tool 74. The pressure readings may be made by receiver 76, and represent a distorted signal 62*b* (FIG. 1). The pressure readings include a plurality of discrete values corresponding to the observed pressure of drilling fluid 50 at specific times. The pressure readings may then be transmitted to storage unit 86 where each pressure reading is collected along with an indicator of the time at which the specific pressure reading was observed (box 104). In some embodiments, pressure readings may be observed (box 102) and stored (box 104) continuously during drilling operations, and concurrently with other operations of procedure 100 described below. An observation vector "b" is generated from the pressure readings in the storage unit (box 106). The observation vector "b" contains a discrete number of pressure readings taken over a time period beginning at to and continuing until $t_{M-1}$ as indicated below.

$$b = \begin{bmatrix} b(t_0) \\ b(t_1) \\ \vdots \\ b(t_{M-1}) \end{bmatrix}$$

An additional operation of procedure 100 may include using decoder 90 to decode the pressure readings (box 108) that were collected in box 102. The operation of decoding the pressure readings (box 108) may be performed prior to, concurrently with, or subsequent to the storage of pressure readings (box 104) and the generation of the observation vector "b" (box 106). The pressure readings may be transmitted directly from receiver 76 to decoder 90, or the pressure readings may be accessed from storage unit 86. Decoder 90 may employ any suitable algorithm to attempt to determine which of the finite number of message signals 62*a* (FIG. 1) that MP tool 74 may have generated is present in the pressure readings observed representing the distorted signal 62*b*. One particular algorithm may include applying an estimated channel impulse response "x" (see box 114) to each of the finite number of possible message signals 62*a*, and comparing the resultant predicted signals to the distorted signal 62*b*. The output of decoder 90 may represent what the decoder determines is the particular signal 62*a* or sequence of particular signals 62*a* with the highest probability of being represented in the pressure readings representing the distorted signal 62*b* (collected in box 102).

Ideal pressure pulses are generated from the results of decoder 90 (box 110). The ideal pressure pulses represent the intended pressure imparted to drilling fluid 50 to generate a particular message signal 62*a* or sequence of message signals 62*a*, which decoder 90 has determined is the most likely signal or sequence to have been generated. The ideal pressure pulses correspond in time to the period of time over which the observation vector "b" spans as well as a period of time prior to the span of the observation vector "b."

Once the ideal pressure pulses are synthesized, the ideal pressure pulses may be organized into a design matrix "A" (box 112). The design matrix "A," illustrated below, is a rectangular matrix having M rows and N columns, and contains a discrete number of synthesized pressure readings taken over a time period beginning at $t_{(1-N)}$ and continuing until $t_{(M-1)}$.

$$A = \begin{bmatrix} p(t_0) & p(t_{-1}) & \dots & p(t_{1-N}) \\ p(t_1) & p(t_0) & & p(t_{2-N}) \\ \vdots & & \ddots & \\ p(t_{M-1}) & p(t_{M-2}) & & p(t_{M-N}) \end{bmatrix}$$

The number of columns used, N corresponds to the time period over which the observation vector "b" spans, and represents the desired length of a finite channel impulse response estimate. The number of rows used, M, corresponds to the number of samples contained in the observation vector "b". The design matrix "A" is a non-symmetrical toeplitz matrix having constant diagonals.

Once the design matrix "A" has been created and the observation vector "b" has been generated, the system of linear equations Ax=b may be solved for "x" (box 114). In order to solve the system of linear equations Ax=b, embodiments of this disclosure implement a least squares method using the Normal Equations (or Wiener-Hopf Equations), namely $$A^T Ax = A^T b$$

where "$A^T$" is the transpose of design matrix "A". "$A^T A$" is a symmetric toeplitz matrix. The number of rows and columns of "$A^T A$" both equal to the number of columns of "A". Because all values of a toeplitz matrix are defined by the values of the first row and the first column, the degrees of freedom of "$A^T A$" are 2(N−1) where "N" is the number of columns of "A". In design matrix "A" which will typically have many more rows than columns, the degrees of freedom are given by M×N, where "M" is the number of rows and "N" is the number of columns of "A". This reduction in degrees of freedom may be desirable when solving the system of linear equations as it may reduce the computational power required.

"$A^TA$" may be referred to as the autocorrelation matrix of the system of equations, and "$A^Tb$" as the cross-correlation between the input vector (the reference pattern sequence) and the actual pressure readings. In at least one embodiment of the present disclosure, the autocorrelation of the reference patterns and the cross-correlation between the reference patterns may be calculated. "$A^TA$" may therefore be assembled using the calculated or estimated autocorrelation vector rather than explicitly calculating "$A^TA$". Likewise, "$A^Tb$" may be assembled using the calculated or estimated cross-correlation vector.

In order to solve the Normal Equations, the system is rearranged to solve for x, and takes the form:

$$x=(A^TA)^{-1}(A^Tb)$$

where "$(A^TA)^{-1}$" is the inverse of "$A^TA$" and may be calculated by, for example, linear operations. In at least one embodiment of the present disclosure, the pseudo inverse of "$A^TA$" is used to solve the system of equations. Using the pseudo inverse of "$A^TA$" may aid in reducing the error in the resulting impulse response estimation, "x". The pseudo inverse may be calculated using singular value decomposition (SVD). Finding the SVD may also enable calculation of the pseudo inverse for a lower-rank approximation of "$A^TA$" instead of the full-rank "$A^TA$". Using the pseudo inverse for a lower-rank approximation of "$A^TA$" may result in a reduction of the error in the resulting impulse response estimation, depending, for example, on the amount of noise contained in the "b" vector of observed pressure readings.

After solving the system of linear equations, the resulting vector "x" is the estimate of the channel impulse response. The estimate of the channel impulse response is a description of the combined effects of all the factors influencing the message signals 62*a* before reaching receiver 76.

Subsequent pressure readings may be collected (box 116) directly from receiver 76 or recovered from storage unit 86. The channel impulse response estimate "x" may then be applied to decode the subsequent readings (box 118). For example, processor 84 may be employed to convolve the channel impulse response estimate "x" with the ideal pressure pulses for each of the finite number of possible signals. The results of this convolution (predicted signals) may be compared to the actual subsequent pressure readings, and decoder 90 may output the most likely represented message signal 62*a* or series of message signals 62*a* that is most similar to the result of the convolution.

This method of decoding signals may be characterized as a "forward" method for applying a channel impulse response estimate. Forward methods may include methods beginning with a finite number of possible message signals 62*a*, where the channel impulse response estimate is applied to each of the finite number of possible message signals 62*a*, and where then the results of that application produces predicted signals that are compared to actual pressure readings representing a distorted signal 62*b*. In contrast, "backward" methods may include methods beginning with pressure readings representing a distorted signal 62*b*, where a channel equalizer "x" is applied to the distorted signal 62*b* to arrive at an estimate of the message signal 62*a*. Since a forward method does not rely on manipulating actual readings, which may contain various noise sources, a forward method does not present the risk of amplifying the various noise sources by the application of the channel equalizer. Thus, in various applications, a forward method will result in a more accurate outcome than a backward method. Whether a forward or backward method is used, the output of decoder 90 may be transmitted to output device 92 for communication to a user.

Figure 3:
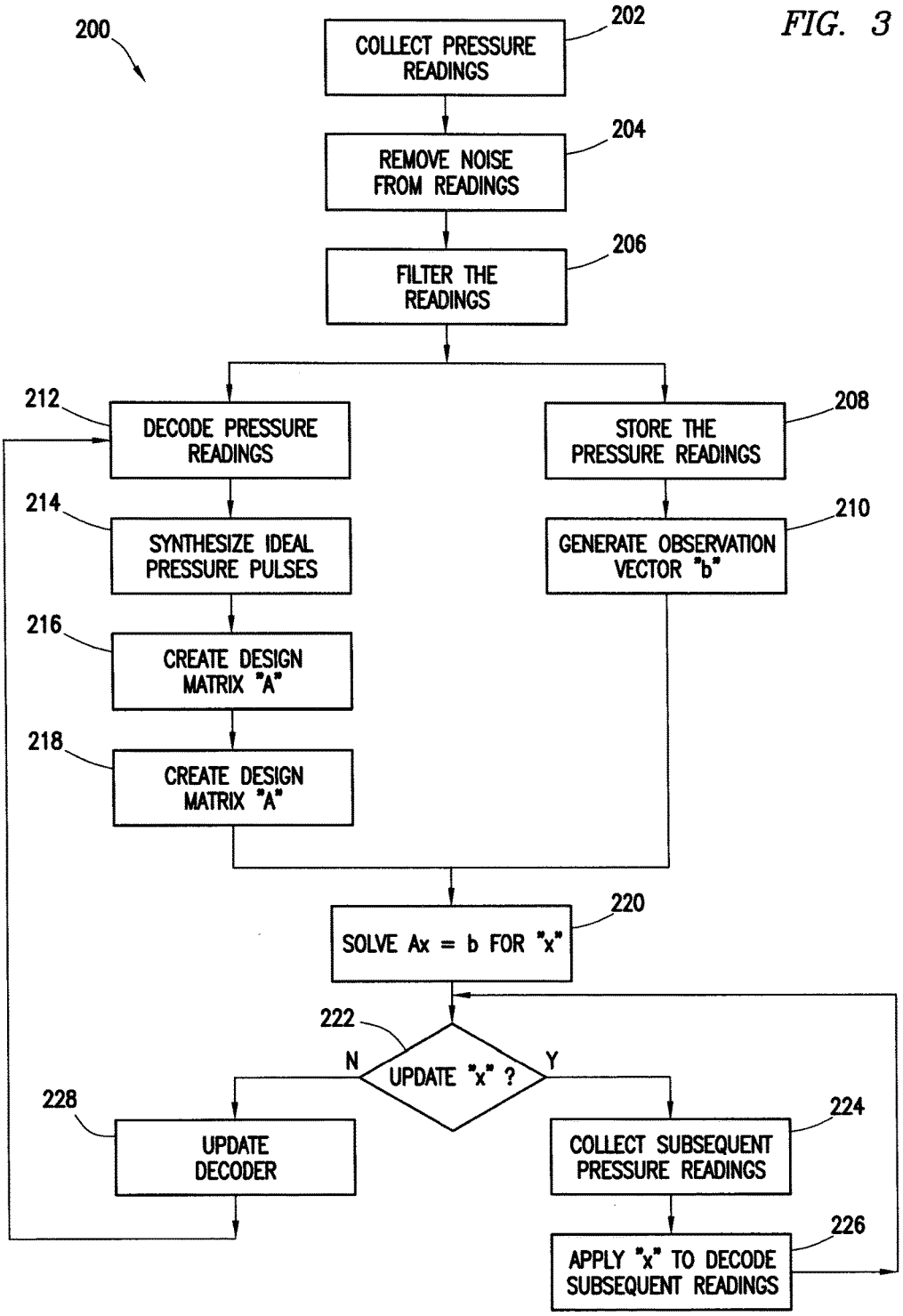
FIG. 3 is a flow chart depicting an alternate method in accordance with the present disclosure including various optional operations.

Referring now to FIG. 3, an alternate embodiment of sequence 200 for determining and applying a finite channel impulse response estimate may include some optional operations. Sequence 200 commences with the collection of pressure readings (box 202) from wellbore 16, wherein the pressure readings include pressure fluctuations induced by MP tool 74. Noise may then be optionally removed from the collected readings (box 204) by pre-processing methods known in the art. Electromagnetic noise cancellation methods as well as methods for cancelling noise generated by mud pump 52 may be contemplated. The pressure readings may also be optionally filtered (box 206). For example, a band pass filter may be employed to remove unwanted frequencies from the pressure readings, such as frequencies outside a range of frequencies of the plurality of known signals.

The resulting noise-cancelled and filtered pressure readings may then be stored (box 208), and an observation vector "b" may be generated from the stored readings (box 210). Prior to, concurrently with, or subsequent to the storage of the pressure readings and generation of the observation vector "b," the noise-cancelled and filtered pressure readings may be decoded (box 212). Ideal pressure pulses may be generated from the results of the decoder (box 214) and a design matrix "A" may be created (box 216) in the manner described above with reference to sequence 100 (FIG. 2).

The design matrix "A" may then be optionally weighted (box 218) to reflect the confidence in various portions of the design matrix "A." As indicated above, each row of the matrix "A" represents a fixed number of estimated samples from a particular time and extending into the past. For particular times where the confidence may be relatively high, e.g., where relatively little noise is present, the corresponding estimated samples may be considered more reliable and given greater weight in subsequent calculation. Weighting the design matrix "A" may be accomplished by employing a predefined algorithm or more heuristic methods may be employed. The weighted design matrix "A" together with the observation vector "b" may then be used to solve the equation Ax=b for "x" (box 220) to arrive at the estimate for the channel impulse response.

Next a decision may be made as to whether or not to update the estimate for the channel impulse response "x" (decision 222). For steady state drilling operations, it may be desirable to update the estimate less often, and for operations with changing conditions, it may be desirable to update the estimate more often. Additionally, it may be desirable to control the average computational load required to estimate "x" by updating the estimate less often, as updating too often may cause high CPU usage in some situations. This may be especially true when long sequences are used in the computation. If it is determined that it is not necessary to update the estimate "x," subsequent pressure readings may be collected (box 224) and, and the estimate "x" may be used to decode the subsequent readings (box 226). Where it is determined that the estimate "x" is to be updated, the decoder may be updated with the estimate "x" (box 228), and the process of decoding the pressure readings (box 212), synthesizing ideal pressure pulses (box 214), creating a design matrix "A" (box 216), weighing the design matrix "A" (box 218) and solving Ax=b for "x" may be repeated.

It will be recognized that the repetition of these operations to update the estimate "x" may be accomplished using the same pressure readings collected in box 202, and, thus using the same observation vector "b" generated in box 210 as depicted in FIG. 3. Alternatively, alternate pressure readings may be extracted from storage unit 86, which may be decoded to create a new design matrix A and a new observation vector b, or subsequent pressure readings collected in box 224 may be used to update the estimate "x."

By updating the channel impulse response estimate "x" in this manner, compensation for changes in the impulse response of the channel may be achieved using the existing communications occurring to support drilling operations. For example, communication of telemetry data does not need to be interrupted to allow for specific test sequences to be transmitted. Also, the ability to continuously update the channel impulse response "x" facilitates compensation for multiple reflections in drilling fluid 50. In some tests, decoder 90 employed in a sequence such as sequence 200 achieved a higher resulting correlation between the impulse response compensated synthesized pressure pulse waveforms that correspond to the transmitted message symbols contained in the pressure readings collected in box 202.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions, and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

The invention claimed is:

1. A method of interpreting a signal comprising the operations of:

defining a finite number of distinct message signals for representing conditions within a wellbore;

transmitting, with a mud pulse tool disposed within the wellbore, a selected one of the finite number of message signals through a drilling fluid disposed within a telemetry channel of the wellbore, the selected one of the finite number of message signals transmitted as a pattern of pressure fluctuations;

receiving, with an up-hole receiver, a distorted signal that includes the selected one of the finite number of message signals as distorted by transmission through the telemetry channel;

transmitting the distorted signal to an interpretation module from the up-hole receiver;

estimating a channel impulse response with the interpretation module, the channel impulse response describing the effects of transmission of the selected one of the finite number of message signals through the telemetry channel, by:

collecting a plurality of observed pressure readings representing the distorted signal;

generating an observation vector "b" including the plurality of observed pressure readings in the form $$b = \begin{bmatrix} b(t_0) \\ b(t_1) \\ \vdots \\ b(t_{M-1}) \end{bmatrix}$$

where b(t) is an observed pressure reading observed at a particular time t, and wherein M represents a predetermined number of observations;

synthesizing ideal pressure pulses corresponding to a message signal of the finite number of message signals;

creating a design matrix "A" including the ideal pressure pulses in the form $$A = \begin{bmatrix} p(t_0) & p(t_{-1}) & \cdots & p(t_{1-N}) \\ p(t_1) & p(t_0) & & p(t_{2-N}) \\ \vdots & & \ddots & \\ p(t_{M-1}) & p(t_{M-2}) & & p(t_{M-N}) \end{bmatrix}$$

where p(t) is an ideal pressure pulse for the particular time t and wherein N represents a predetermined length of the estimated channel impulse response; and solving the system of linear equations Ax=b for "x," where "x" represents the estimated channel impulse response by:

calculating a transposition of design matrix "A", defined as "$A^T$";

solving the normal equations $A^TAx=A^Tb$ for "x", therefore:

$$x=(A^TA)^{-1}A^Tb,$$

where "$(A^TA)^{-1}$" is the inverse of "$A^TA$";

applying, with the interpretation module, the estimated channel impulse response to at least one of the finite number of distinct message signals to generate at least one predicted signal;

making a comparison between the at least one predicted signal and the distorted signal with the interpretation module; and estimating an estimated signal with the interpretation module, the estimated signal corresponding to which of the finite number of message signals is included in the distorted signal based on the comparison.

2. The method of interpreting a signal according to claim 1, further comprising:

calculating an autocorrelation vector of a reference pattern sequence;

calculating a cross-correlation between the reference pattern sequence and the distorted signal; and populating "$A^TA$" with the autocorrelation vector and "$A^Tb$" with the cross-correlation.

3. The method of interpreting a signal according to claim 1, further comprising filtering the plurality of observed pressure readings to remove a predefined frequency range.

4. The method of interpreting a signal according to claim 1, wherein a pseudo inverse of "$A^TA$" is substituted for "$(A^TA)^{-1}$" in solving the system of normal equations.

5. The method of interpreting a signal according to claim 4, wherein the pseudo inverse of "$A^TA$" is found using singular value decomposition (SVD).

6. The method of interpreting a signal according to claim 5, wherein the pseudo inverse of "$A^TA$" is calculated for a lower-rank approximation of "$A^TA$" than the full rank of "$A^TA$".

7. The method of interpreting a signal according to claim 1, further comprising the operations of:

collecting a plurality of subsequent pressure readings representing a subsequent signal;

making a comparison between the at least one predicted signal and the subsequent signal; and estimating which of the finite number of message signals is included in the subsequent signal based on the comparison.

8. An interpretation module for interpreting data received from a telemetry channel of a wellbore, the interpretation module comprising:

a storage unit including a non-transitory, computer readable medium for storing a plurality of pressure readings representing a distorted signal received from the telemetry channel;

a decoder including a non-transitory, computer readable medium including instructions for estimating and outputting an estimated signal representing which of a finite number of predetermined message signals is included in the plurality of pressure readings representing the distorted signal; and a processor for estimating a channel impulse response "x" for the telemetry channel, the processor including a non-transitory, computer readable medium including instructions for generating an observation vector "b" including the plurality of pressure readings representing the distorted signal, creating a design matrix "A" including ideal pressure pulses synthesized representing the estimated signal, and for solving the equation Ax=b for "x" to arrive at an estimated channel impulse response "x";

wherein the processor further comprises instructions for calculating a transposition of design matrix "A", defined as "$A^T$", solving the normal equations $A^TAx=A^Tb$ for "x", resulting in $x=(A^TA)-1A^Tb$, where "$(A^TA)-1$" is the inverse of "ATA".

9. The interpretation module according to claim 8, wherein a pseudo inverse of "$A^TA$" is substituted for "$(A^TA)-1$" in solving the normal equations.

10. The interpretation module according to claim 9, wherein the pseudo inverse of "$A^TA$" is found using singular value decomposition (SVD).

11. The interpretation module according to claim 10, wherein the pseudo inverse of "$A^TA$" is calculated for a lower-rank approximation of "$A^TA$" than the full rank of "$A^TA$".

12. The interpretation module according to claim 8, wherein the decoder comprises instructions to employ a forward method of applying the estimated channel impulse response "x" for estimating and outputting the estimated signal.

13. The interpretation module according to claim 12, wherein the processor comprises instructions for updating the estimated channel impulse response "x," and wherein the decoder includes instructions to employ the updated estimated channel impulse response "x".

14. The interpretation module according to claim 12, wherein the processor comprises instructions for creating the design matrix "A" and the observation vector b in the forms $$A = \begin{bmatrix} p(t_0) & p(t_{-1}) & \cdots & p(t_{1-N}) \\ p(t_1) & p(t_0) & & p(t_{2-N}) \\ \vdots & & \ddots & \\ p(t_{M-1}) & p(t_{M-2}) & & p(t_{M-N}) \end{bmatrix}$$

$$b = \begin{bmatrix} b(t_0) \\ b(t_1) \\ \vdots \\ b(t_{M-1}) \end{bmatrix}$$

where p(t) is an ideal pressure pulse for the particular time t, M+N−1 represents the number of unique samples in "A", N represents a predetermined length of the estimated channel impulse response, and wherein b(t) is an observed pressure reading observed at a particular time t, and wherein M represents a predetermined number of observations.

15. The interpretation module according to claim 8, further comprising an output module including a display screen configured to display the estimated signal output by the decoder.

* * * * *